US005895296A

United States Patent [19]

Okabe

[11] Patent Number: 5,895,296

[45] Date of Patent: Apr. 20, 1999

[54] COMBINED-TYPE CONNECTOR

[75] Inventor: Toshiaki Okabe, Shizuoka, Japan

[73] Assignee: Yazaki Corporation, Tokyo, Japan

[21] Appl. No.: 08/916,279

[22] Filed: Aug. 22, 1997

[30] Foreign Application Priority Data

Aug. 27, 1996 [JP] Japan ..... 8-225360

[51] Int. Cl.[6] ..... H01R 13/502

[52] U.S. Cl. ..... 439/701

[58] Field of Search ..... 439/701, 717, 439/595

[56] References Cited

U.S. PATENT DOCUMENTS 4,753,614 6/1988 Weiner ..... 439/717
4,872,855 10/1989 Norden ..... 439/717

FOREIGN PATENT DOCUMENTS 553154 7/1993 Japan .

*Primary Examiner*—Khiem Nguyen
*Attorney, Agent, or Firm*—Sughrue, Mion, Zinn, Macpeak & Seas, PLLC

[57] ABSTRACT

At least one generally box-shaped connector housing capable of being stacked upon similar housings, each of the connector housings having upper and lower walls. A combined-type connector having a plurality of such box-shaped connectors. Lance holes (retaining holes) for respectively retaining terminals inserted respectively in terminal receiving chambers in the connector housing are formed through the upper wall of each of the connector housings, and connecting hooks are formed on the lower wall of the connector housing, and are inserted and retained respectively in the lance holes, thereby connecting the upper and lower connector housings together.

8 Claims, 10 Drawing Sheets

COMBINED-TYPE CONNECTOR

BACKGROUND OF THE INVENTION

This invention relates to a combined-type connector comprising a plurality of connector housings stacked one upon another and connected together.

FIG. 13 shows a combined-type connector disclosed in Japanese Utility Model Unexamined Publication No. Hei. 5-53154. This combined-type connector comprises a plurality of generally box-shaped connector housings 1 stacked one upon another and connected together, each of the connector housings having upper and lower flat walls. Downwardly-extending engagement hooks 2 are formed respectively at lower edges of right and left side walls of each connector housing 1, and engagement portions 3 for retaining engagement with the associated engagement hooks 2 are formed respectively in outer surfaces of these right and left side walls by notching. The connector housings 1 are stacked one upon another, and in this condition the engagement hooks 2 of the upper one of any two adjacent connector housings 1 are retainingly engaged respectively in the engagement portions 3 of the lower connector housing 1, so that the adjacent connector housings 1 are fixedly combined together, thereby forming the combined-type connector.

In the above combined-type connector, the engagement hooks 2, as well as the engagement portions 3, are formed respectively at the right and left side walls of each connector housing 1 so that the connector housings can be connected together, and therefore a space for these portions must be provided at each of the right and left sides of the connector housing, so that the width of the connector could not be reduced.

Furthermore, in the case of a multi-pole connector in which many terminals are juxtaposed in a right-left direction, there has been encountered a problem that a central portion of the connector between the right and left sides is raised or bulged since the connector housings are connected together only at the right and left sides.

SUMMARY OF THE INVENTION

With the above problems in view, it is an object of this invention to provide a combined-type connector in which the increase of the width of the connector is suppressed as much as possible, and the bulging of a central portion is prevented in a combined condition of the connector.

According to a first aspect of the invention, there is provided a combined-type connector comprising a plurality of generally box-shaped connector housings stacked one upon another and connected together, each of the connector housings having upper and lower flat walls; characterized in that retaining holes are formed in at least one of the joined walls of any two adjacent stacked connector housings; and connecting hooks are formed on at least one of the joined walls of the two adjacent connector housings, and are inserted and retained respectively in the retaining holes, thereby connecting the stacked connector housings together.

In this connector, the stacked connector housings can be connected together by retainingly engaging the connecting hooks respectively in the retaining holes. At this time, the connecting hooks are engaged in the respective retaining holes even at the central portions of the connector housings intermediate the right and left sides thereof, and therefore the central portions of the connector housings in the right-left direction are prevented from being bulged or raised.

The retaining holes may be formed in one of any two adjacent stacked connector housings while the connecting hooks may be formed on the other of the two adjacent connector housings, or vice versa. Alternatively, the retaining holes and the connecting hooks may be provided at one of the two adjacent connector housings, and also the retaining holes and the connecting hooks may be provided at the other.

According to a second aspect of the invention, in a combined-type connector of the first aspect, the retaining holes are defined respectively by lance holes formed through the upper wall of one of any two adjacent stacked connector housings, and the lance holes respectively retain terminals inserted respectively in terminal receiving chambers in the connector housing, and the connecting hooks are formed on the lower wall of the other of the two adjacent connector housings.

In this connector, the upper and lower connector housings can be connected together by retainingly engaging the connecting hooks respectively in the lance holes which respectively retain the terminals. At this time, the connecting hooks are engaged in the respective lance holes even at the central portions of the connector housings intermediate the right and left sides thereof, and therefore the central portions of the connector housings in the right-left direction are prevented from being bulged or raised.

According to a third aspect of the invention, in a combined-type connector of the second aspect, a large number of the terminal receiving chambers are juxtaposed in the connector housing in a right-left direction, and in accordance with the arrangement of the terminal receiving chambers, a large number of the lance holes, as well as a large number of the connecting hooks, are juxtaposed in the right-left direction with respect to the connector housings.

In this connector, many connecting hooks jointly provide the connecting force, and therefore the connecting force per connecting hook is small, and the connecting hook can be formed into a small size.

According to a fourth aspect of the invention, in a combined-type connector of the second or third aspect, the lance holes and the connecting hooks are provided at a front end portion of the connector housing, and additional connecting portions are provided at a rear end portion of the connector housing, and the additional connecting portions of one of any two adjacent stacked connector housings can be connected respectively to the additional connecting portions of the other of the two adjacent connector housings.

In this connector, the upper and lower connector housings are connected together at their front and rear end portions, and therefore the high connecting force can be maintained.

BRIEF DESCRIPTION OF THE DRAWINGS

FIG. 7(*b*) is an enlarged view of a portion VII*b* of FIG. 5;

DETAILED DESCRIPTION OF THE INVENTION

Preferred embodiments of the present invention will now be described with reference to the drawings.

Figure 1:
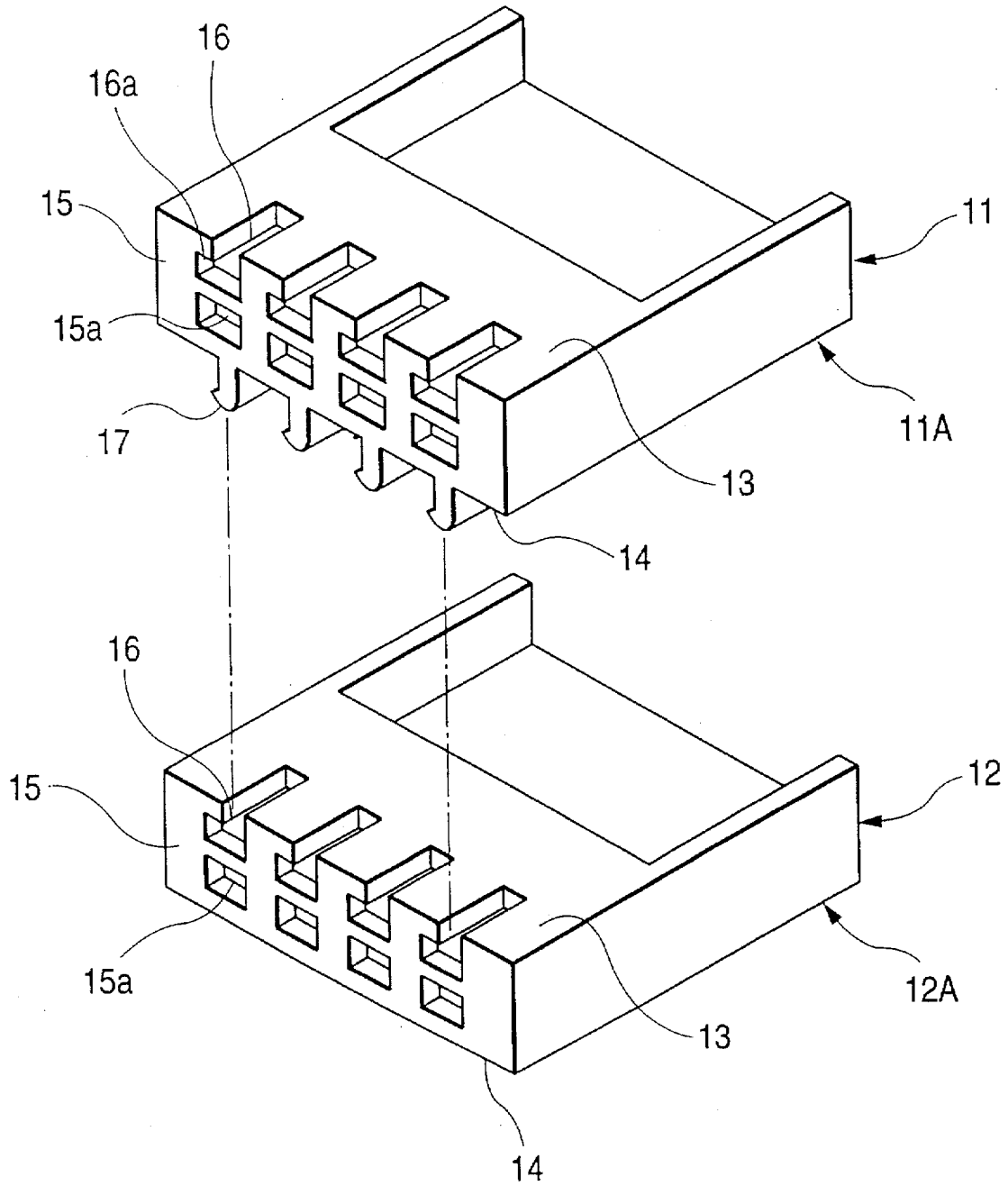
FIG. 1 is a perspective view showing a first embodiment of a combined-type connector of the invention in a condition before a combined condition.

FIG. 1 shows a first embodiment of a combined-type connector in a condition before a combined condition. This combined-type connector comprises an upper connector 11 and a lower connector 12 which are stacked one upon the other, and are connected together. The upper connector 11 and the lower connector 12 have substantially the same construction and size, and the upper connector will be first described with reference to FIGS. 1 and 2.

A housing 11A of the upper connector 11 has a generally box-shape, and includes upper and lower flat walls 13 and 14, and this housing 11A has a plurality of terminal receiving chambers 18 formed therein, these chambers 18 being juxtaposed in a right-left direction. A front end of each terminal receiving chamber 18 is formed into a mating terminal-inserting hole 15*a* open to the exterior. Lance holes (retaining holes) 16 are formed in the upper wall 13 of the connector housing 11A, and are disposed in correspondence with front end portions of the terminal receiving chambers 18, respectively. The lance holes 16 extend through a front end wall 15 of the connector housing 11A by notching, and L-shaped holes 16*a* are formed in the front end wall 15, and are continuous with the lance holes 16, respectively.

Figure 2:
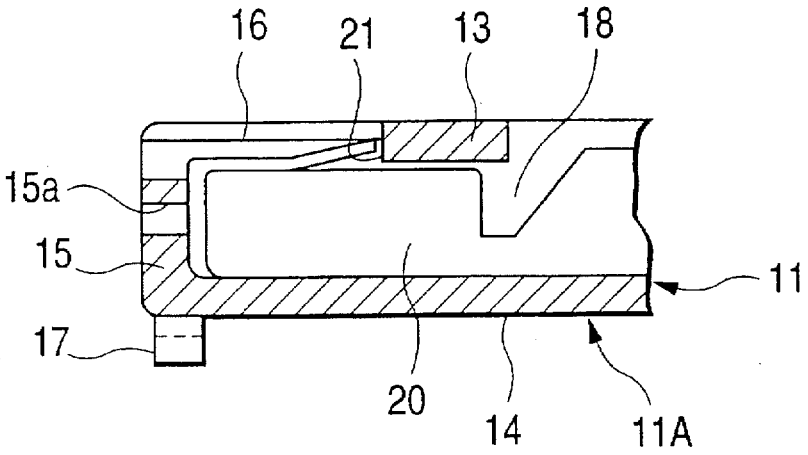
FIG. 2 is a side cross-sectional view of an upper connector of FIG. 1.

As shown in FIG. 2, each lance hole 16 retains a lance (elastic spring piece portion) 21 of a terminal 20 inserted into the terminal receiving chamber 18 from the rear side, and extends from the outer surface to the associated terminal receiving chamber 18.

As shown in FIG. 1, similarly, terminal receiving chambers 18, mating terminal-inserting holes 15*a* and lance holes 16 are formed in the lower connector 12. Connecting hooks 17 are formed on and project from the lower wall 14 of the housing 11A of the upper connector, and these connecting hooks 17 are retainingly engaged respectively in the lance holes 16 formed in an upper wall 13 of a housing 12A of the lower connector 12. The connecting hooks 17 correspond respectively to the lance holes 16 (but the connecting hooks may correspond respectively to part of the lance holes 16). The connecting hooks 17 are so provided as not to interfere with the lances 21 retained respectively in the lance holes 16. No connecting hook is formed on the housing 12A of the lower connector 12 (FIG. 1) since no connector is intended to be connected to the lower side of the lower connector 12.

Figure 3:
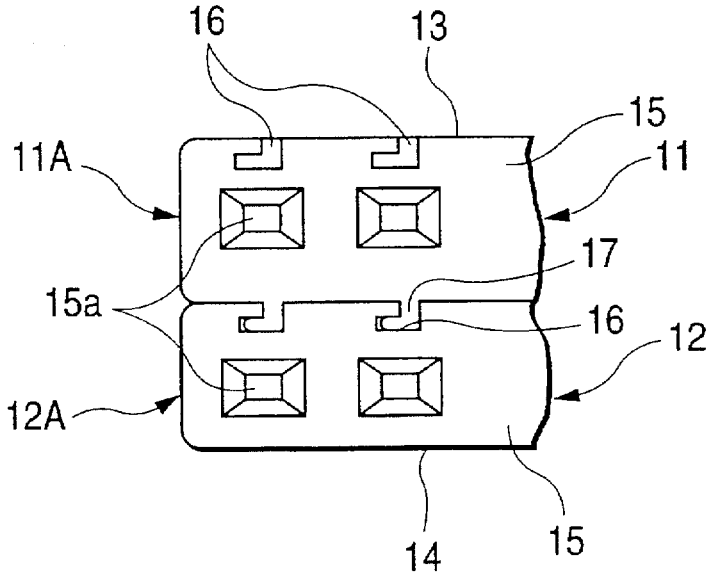
FIG. 3 is a fragmentary, front-elevational view showing the upper and lower connectors stacked together in the combined condition.

In this combined-type connector, the terminals 20 are inserted respectively into the terminal receiving chambers 18 in each of the connector housings 11A and 12A, and the lances 21 are retained respectively in the lance holes 16, and in this condition the upper and lower connector housings 11A and 12A are stacked one upon the other as shown in FIG. 3, and the connecting hooks 17, formed on the lower wall 14 of the upper connecter housing 11A, are inserted and retained in the lance holes 16 in the lower connector housing 12A, thereby connecting the two connector housings 11A and 12A together.

In this combined-type connector, the upper and lower connector housings 11A and 12A are connected together by retainingly engaging the connecting hooks 17 respectively in the lance holes 16, and therefore there is no need to provide any connecting means at the right and left (opposite) sides of the connectors 11 and 12, and the increase of the width in the right-left direction can be suppressed. The connecting hooks 17 are engaged respectively in the lance holes 16 at suitable regions spaced from one another in the right-left direction with respect to the connector housings 11A and 12A, and therefore even if the connector is of the multi-pole type, the central portions of the connector housings 11A and 12A intermediate the right and left sides thereof are positively prevented from being raised or bulged. And besides, since many connecting hooks 17 jointly provide the total connecting force, the force per connecting hook 17 is small, and therefore the connecting hooks 17 can be formed into a small size.

In the above embodiment, although the number of the connecting stages is two, it is not limited to two, but may be three or more in which case the connecting hooks do not need to be formed on a lowermost connector housing.

Next, a second embodiment of the invention will be described with reference to FIGS. 4 to 11.

Figure 4A:
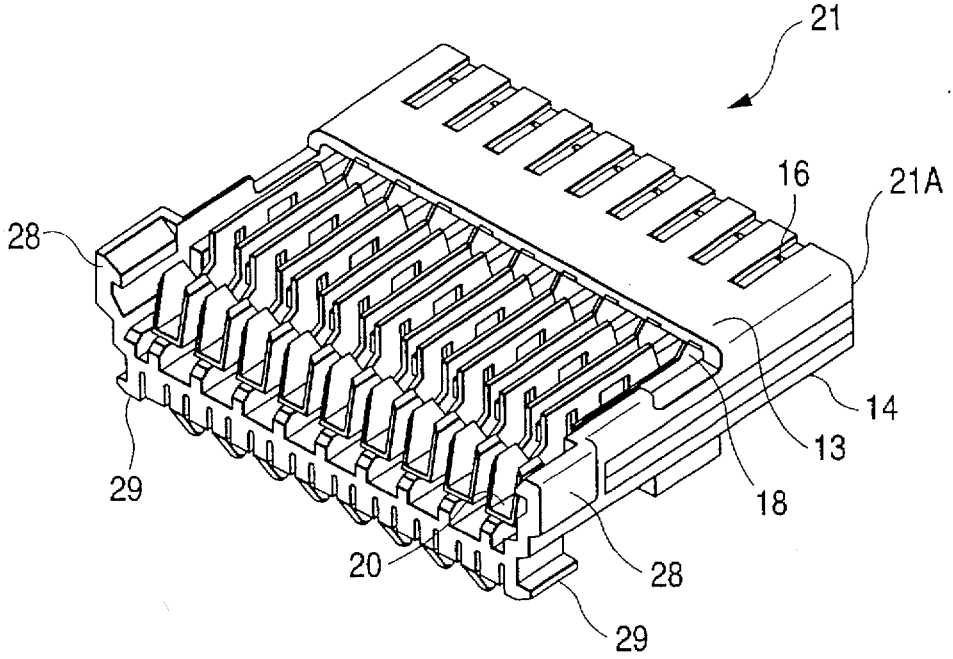
FIGS. 4(*a*) and 4(*b*) show an upper connector of a second embodiment of a combined-type connector of the invention, FIG. 4(*a*) being a perspective view as seen from the upper side, and FIG. 4(*b*) being a perspective view showing the upper connector turned over.
Figure 4B:
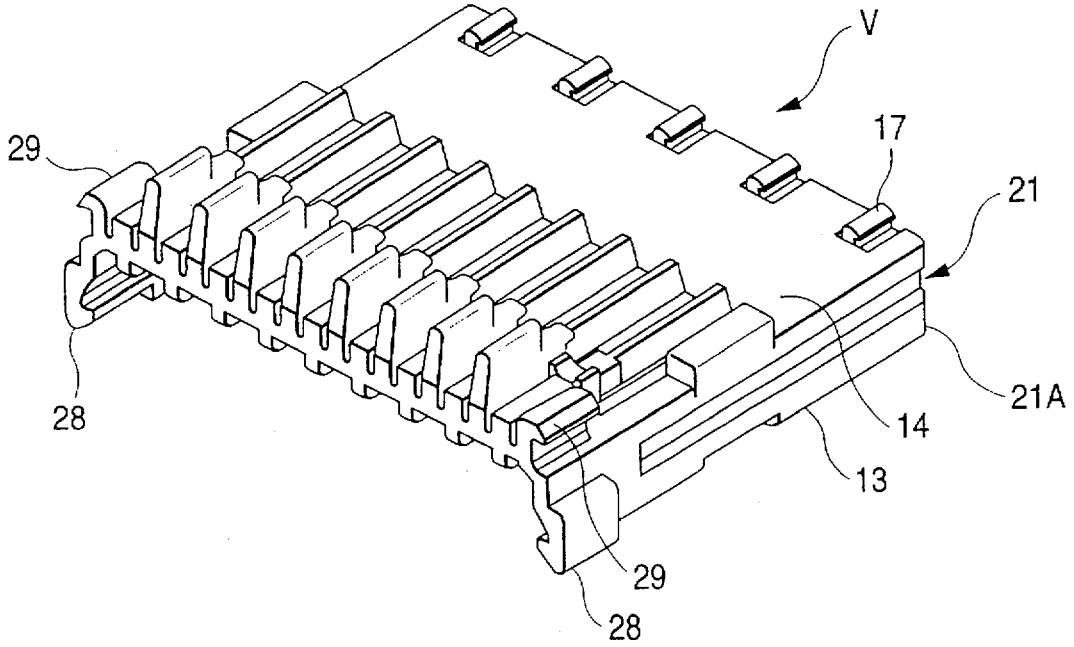
Figure 5:
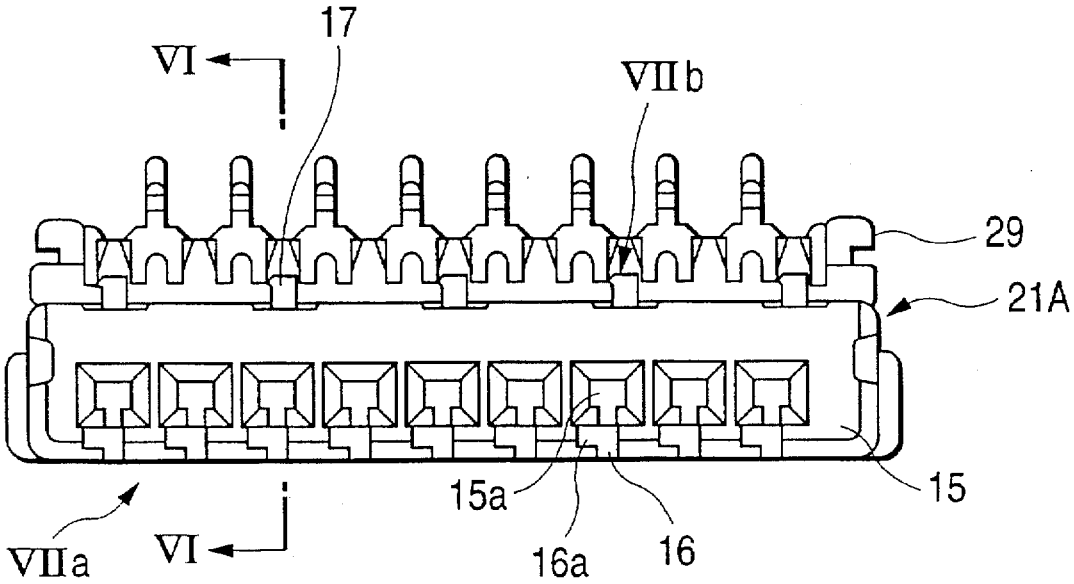
FIG. 5 is a view as seen in a direction of arrow V of FIG. 4(*b*)
Figure 6:
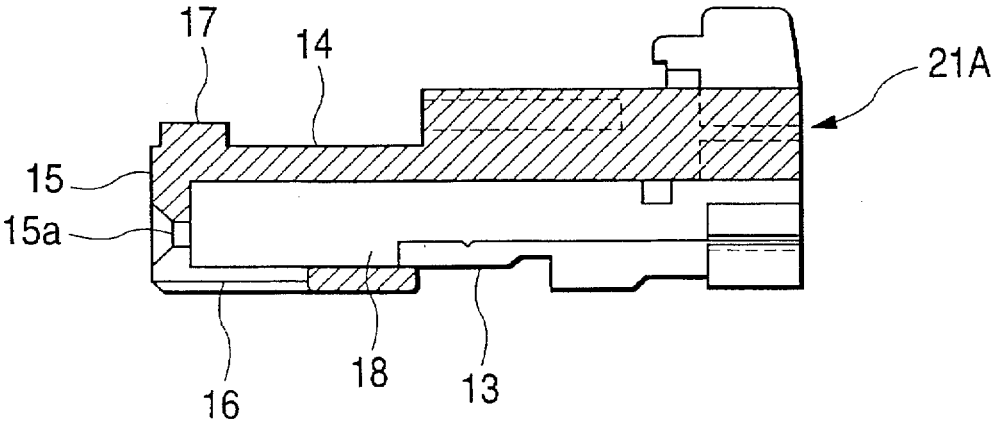
FIG. 6 is a sectional view as seen in a direction of arrow VI—VI of FIG. 5.

FIGS. 4(*a*) and 4(*b*) show an upper connector 21 of a combined-type connector of the second embodiment, and FIG. 4(*a*) is a perspective view showing an upper side thereof, and FIG. 4(*b*) is a perspective view showing a lower side of this upper connector turned over. FIG. 5 is a front-elevational view of the connector 21, and FIG. 6 is a side cross-sectional view showing a terminal receiving chamber 18, with a terminal omitted.

As shown in FIG. 4(*a*), a housing 21A of the upper connector 21 has an upper wall 13 provided only at a front half portion thereof, and a rear half portion thereof is open upwardly. This upwardly-open portion is provided to facilitate the press-connecting of wires to terminals 20, and is closed by another connector housing 21A or an upper cover 23 (see FIG. 10) placed thereon. As in the first embodiment, this connector housing 21A has lance holes 16 formed in a front portion of the upper wall 13, and connecting hooks 17 for retaining engagement in associated lance holes 16 are formed on a front portion of a lower wall 14.

Figure 7A:
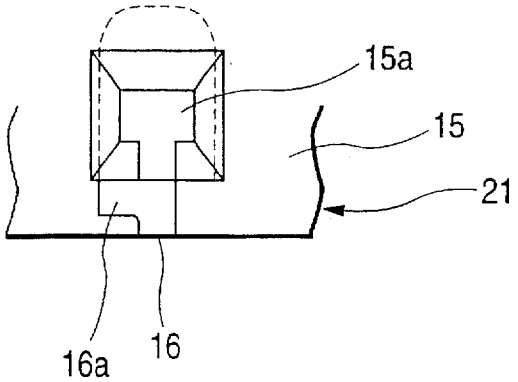
FIG. 7(*a*) is an enlarged view of a portion VII*a* of FIG. 5.
Figure 7B:
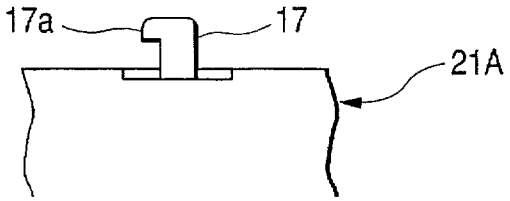
Figure 8A:
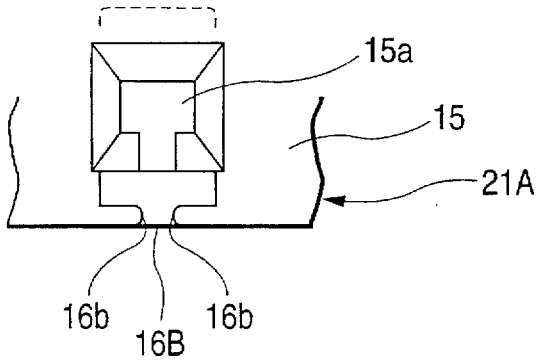
FIGS. 8(*a*) and 8(*b*) are views showing a modification of that portion shown in FIGS. 7(*a*) and 7(*b*)
Figure 8B:
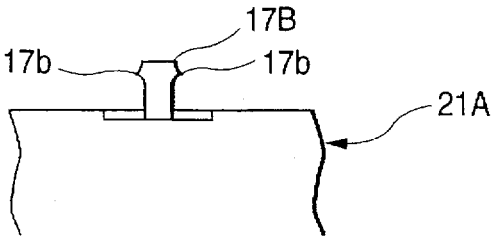

The relation between the lance hole 16 and the connecting hook 17 is as shown in FIGS. 7(*a*) and 7(*b*). More specifically, the connecting hook 17 has a retaining pawl 17*a* formed at its distal end and projecting from one side thereof, and this retaining pawl 17*a* is inserted into the lance hole 16, thereby connecting the connecting hook 17 to the lance hole 16 against disengagement. The retaining pawl 17*a* and the lance hole 16 may be modified in configuration as shown in FIGS. 8(*a*) and 8(*b*). In the example shown in FIGS. 8(*a*) and 8(*b*), projections 17*b* are formed respectively on opposite sides of a connecting hook 17B, and projections 16b for engagement with the projections 17*b* are formed at an inlet portion of the associated lance hole 16B.

As shown in FIGS. 4(*a*) and 4(*b*), inwardly-directed hooks (other connecting portions) 28 are formed respectively at upper portions of right and left sides of the rear end portion of the connector housing 21, and outwardly-directed hooks (other connecting portions) 29 are formed respectively at lower portions of the right and left sides of the rear end portion of the connector housing 21. When the connector housing 21A is stacked on another connector housing, the inwardly-directed hooks 28 are engaged respectively with the outwardly-directed hooks 29 on the upper-side connector housing.

Figure 9:
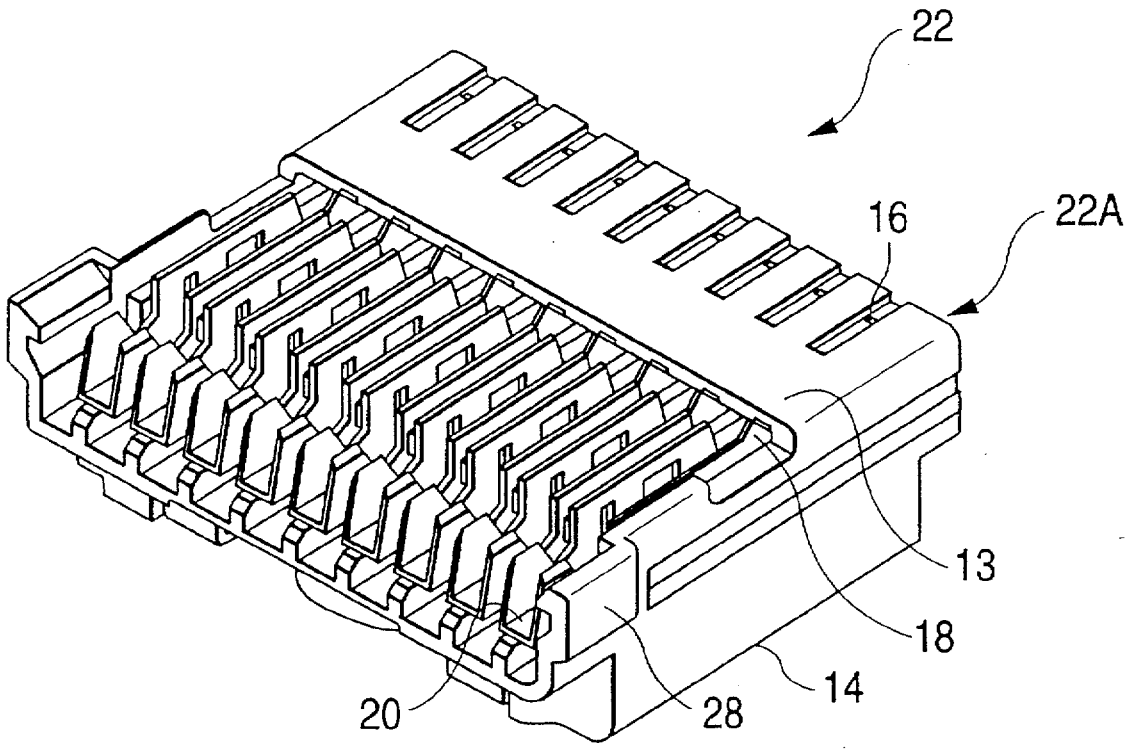
FIG. 9 is a perspective view of a lower connector of the second embodiment of the combined-type connector of the invention, as seen from the upper side.

FIG. 9 shows a lower connector 22. Any connecting hook is not formed on a lower wall 14 of a housing 22A of this connector 22, and any outwardly-directed hook is formed on a lower portion of a rear end portion of the housing 22A. Except these, this connector housing 22A has the same construction as that of the upper connector housing 21A.

Figure 10:
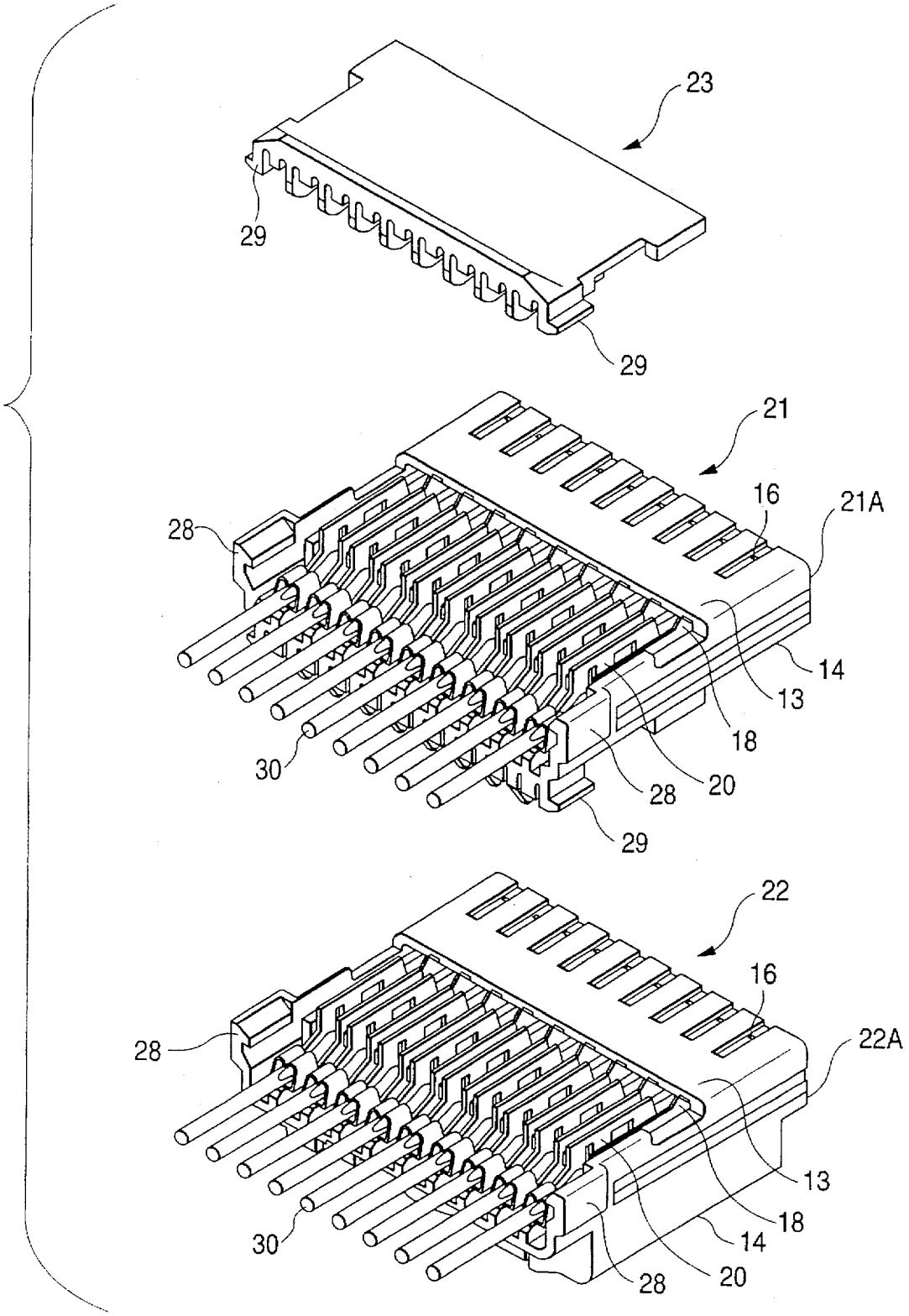
FIG. 10 is a perspective view showing the upper connector, the lower connector and an upper cover of the second embodiment of the combined-type connector of the invention.
Figure 11:
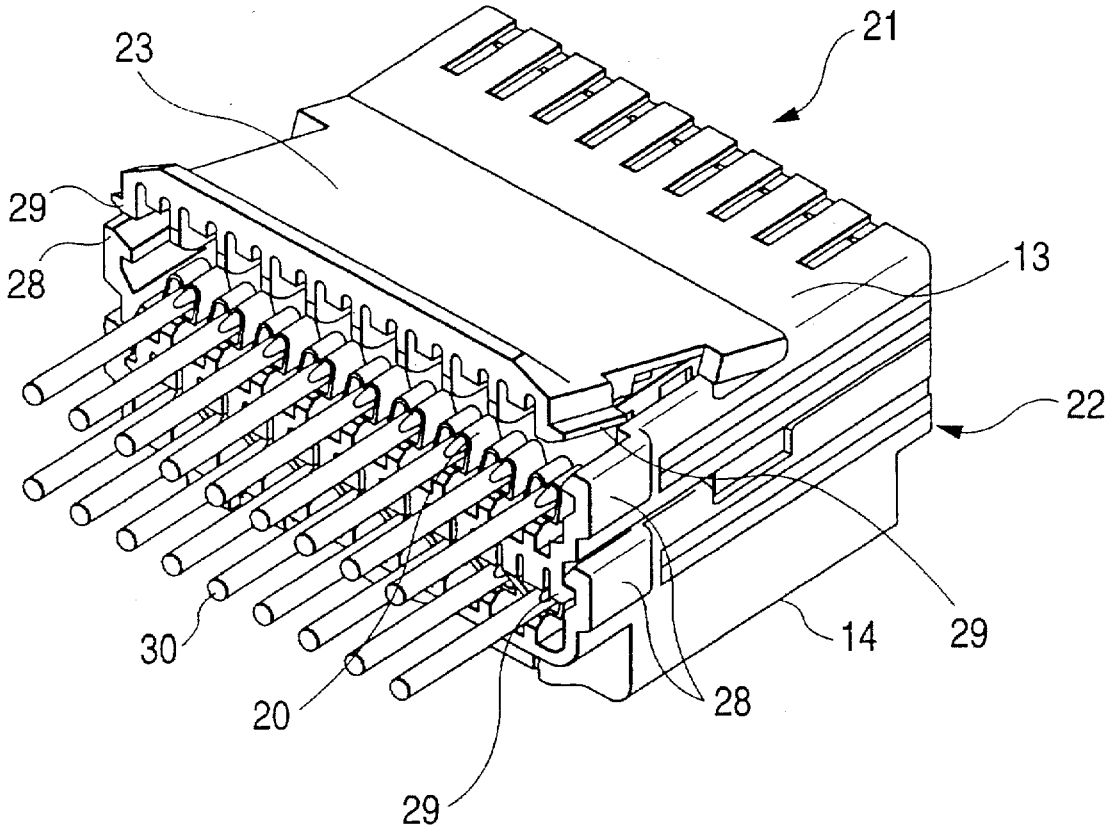
FIG. 11 is a perspective view showing a condition in which the three parts of FIG. 10 are combined together.

For assembling the combined-type connector, the terminals 20 are mounted in the two connector housings 21A and 22A, and then wires are press-connected respectively to the terminals, as shown in FIG. 10. Then, the upper connector 21 is placed on the upper surface of the lower connector 22, and the connecting hooks (see FIG. 4) on the upper connector 21 are inserted and retained in the associated lance holes 16 in the lower connector 22. At the same time, the outwardly-directed hooks 29, formed at the rear end portion of the connector 21, are engaged respectively with the inwardly-directed hooks 28, formed at the rear end portion of the lower connector 22, and finally outwardly-directed hooks 29, formed on a rear end portion of the upper cover 23, are engaged respectively with the inwardly-directed hooks 28 on the upper connector 21, thereby finishing the assembling of the combined-type connector of this embodiment, as shown in FIG. 11.

In this combined-type connector, the connector housings 21A and 22A of the upper and lower connectors 21 and 22 are connected together at their front and rear end portions, and therefore even if the connector housings 21A and 22A have an increased length in the forward-rearward direction, the high connecting force can be maintained.

Next, a third embodiment, shown in FIG. 12, will be described. In the above-mentioned first embodiment, the connecting hooks 17 are formed on the lower wall 14 of the upper connector 11, and are inserted and retained respectively in the lance holes 16 in the upper wall 13 of the lower connector 12, thereby connecting the upper connector 11 and the lower connector 12 together. In this third embodiment, as shown in FIG. 12, connecting hooks 17 are further formed on an upper wall 13 of a lower connector 12, and are inserted and retained respectively in retaining holes 36 formed in a lower wall 14 of an upper connector 11, thereby connecting the upper connector 11 and the lower connector 12 together.

Figure 12:
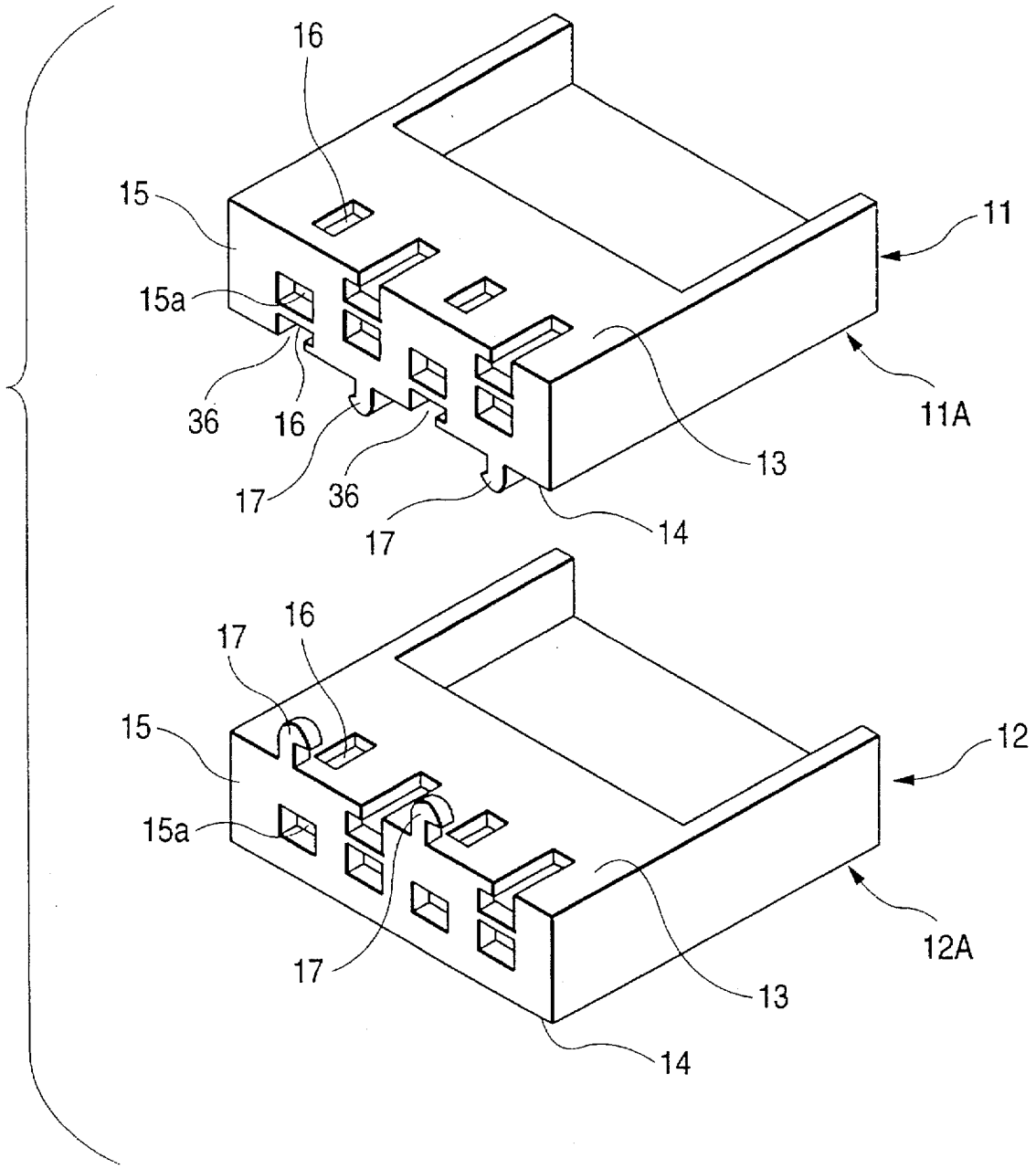
FIG. 12 is a perspective view showing an upper connector and a lower connector of a third embodiment of a combined-type connector of the invention.
Figure 13:
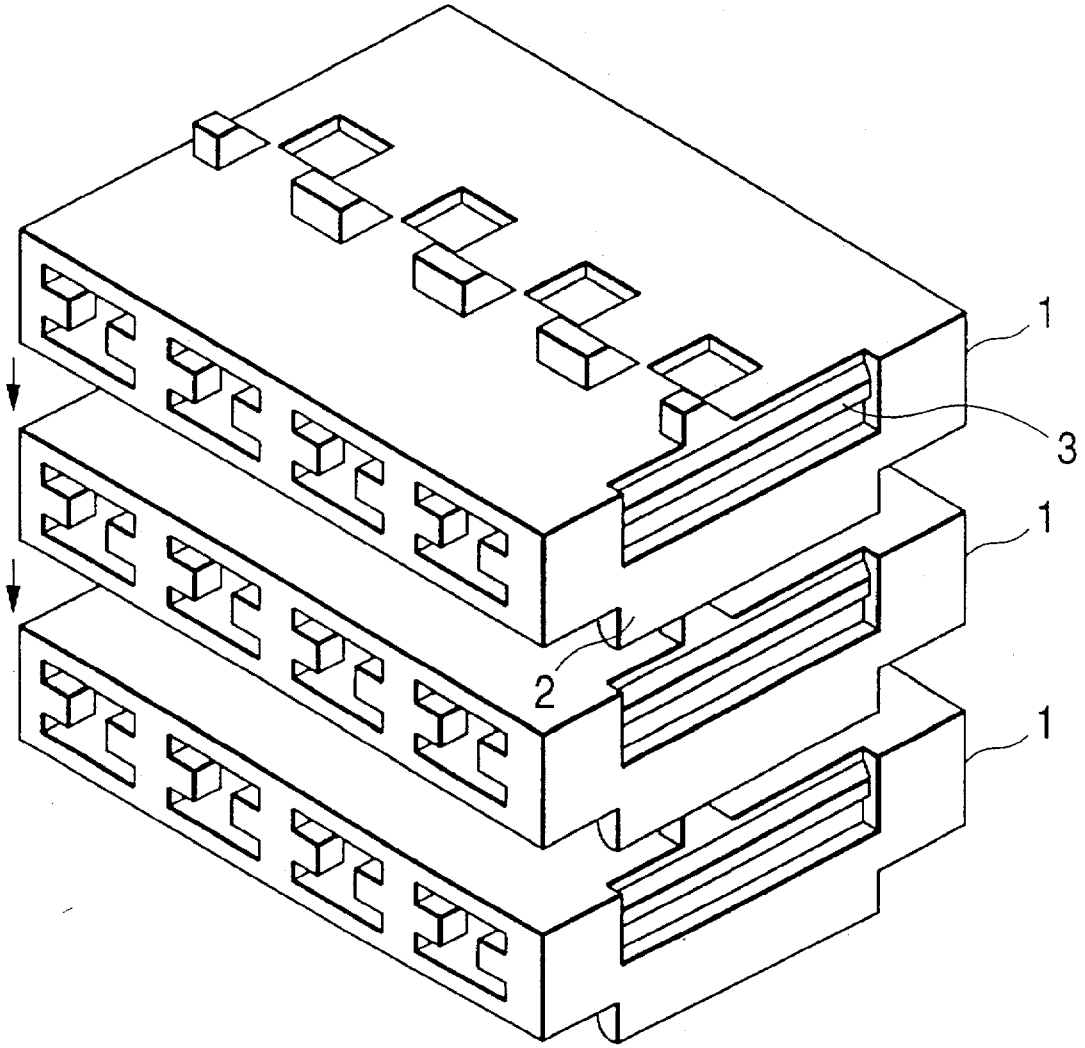
FIG. 13 PRIOR ART
FIG. 13 is a perspective view showing a conventional combined-type connector in a condition before a combined condition.

Each of the retaining hole 36, formed in the lower wall 14 of the upper connector 11, may have an L-shape as shown in FIG. 12, in which case the associated lance hole 16 is open to the outer surface of the lower wall 14, and a hole is formed in a front end wall 15 in continuous relation to the lance hole 16, thereby forming the L-shaped retaining hole 36. Alternatively, each retaining hole 36 may be a hole simply formed in the lower wall 14 of the upper connector 11.

As described above, in the first aspect of the invention, the upper and lower connector housings can be connected together by retainingly engaging the connecting hooks respectively in the retaining holes formed in the lower wall or the upper wall. Therefore, there is no need to provide any connecting means at the right and left sides of the connector, so that the increase of the width of the connector in the right-left direction can be suppressed.

The connecting hooks are engaged in the respective retaining holes even at the central portions of the connector housings between the right and left sides thereof, and therefore the central portions of the connector housings intermediate the right and left sides thereof are prevented from being bulged or raised.

In the second aspect of the invention, the upper and lower connector housings can be connected together by retainingly engaging the connecting hooks respectively in the lance holes which respectively retain the terminals, and therefore there is no need to provide any connecting means at the right and left sides of the connector, so that the increase of the width of the connector in the right-left direction can be suppressed. The connecting hooks are engaged in the respective retaining lances even at the central portions of the connector housings between the right and left sides thereof, and therefore the central portions of the connector housings intermediate the right and left sides thereof are prevented from being bulged or raised. The lance holes are used as the holes for respectively receiving the connecting hooks, and therefore any additional hole for connecting purposes does not need to be formed in the connector housing, and therefore the construction is simplified.

In the third aspect of the invention, even if the connector is of the multi-pole type having many juxtaposed terminals, the upper and lower connector housings can be connected together by retainingly engaging many connecting hooks in the respective lance holes, and therefore the central portions of the connector housings intermediate the right and left sides thereof are positively prevented from being bulged or raised. Many connecting hooks jointly provide the connecting force, and therefore the connecting force per connecting hook is small, and the connecting hook can be formed into a small size.

In the fourth aspect of the invention, the upper and lower connector housings are connected together at their front and rear end portions, and therefore even if the connector housings have an increased length in the forward-rearward direction, the high connecting force can be maintained.

What is claimed is:

1. A combined-type connector comprising a plurality of generally box-shaped connector housings stacked one upon another and connected together, each of said connector housings having upper and lower flat walls;

wherein retaining holes are formed in at least one of joined walls of any two adjacent stacked connector housings;

wherein connecting hooks are formed on at least the other of said joined walls, and are inserted and retained respectively in said retaining holes, thereby connecting said adjacent stacked connector housings together; and wherein said retaining holes are lance holes formed through an upper wall of one of the two adjacent stacked connector housings, said lance holes respectively retaining lances of terminals inserted respectively in terminal receiving chambers in said one of the connector housings; and said connecting hooks are formed on a lower wall of the other of the two adjacent stacked connector housings.

2. A combined-type connector according to claim 1, wherein a plurality of said terminal receiving chambers are juxtaposed in said connector housing in a right-left direction, and in accordance with the arrangement of said terminal receiving chambers, a plurality of said lance holes, as well as a plurality of said connecting hooks, are juxtaposed in the right-left direction with respect to said connector housing.

3. A combined-type connector according to claim 1, wherein said lance holes and said connecting hooks are respectively provided at a front end portion of said respective connector housings, and additional connecting portions are provided at a rear end portion of said respective connector housings, said additional connecting portions of one of any two adjacent stacked connector housings being respectively engageable with said additional connecting portions of the other of the two adjacent stacked connector housings.

4. A combined-type connector according to claim 2, wherein said lance holes and said connecting hooks are respectively provided at a front end portion of said respective connector housings, and additional connecting portions are provided at a rear end portion of said respective connector housings, said additional connecting portions of one of any two adjacent stacked connector housings being respectively engageable with said additional connecting portions of the other of the two adjacent stacked connector housings.

5. A combined-typed connector according to claim 3, further comprising an upper cover which engages with said additional connecting portions.

6. A combined-typed connector according to claim 4, further comprising an upper cover which engages with said additional connecting portions.

7. A connector housing adapted for stacking upon one or more similar connector housings, said connector housing having upper and lower walls;

wherein holes are formed in at least one of said upper and lower walls, adapted to be engagable with a retaining lance of a terminal insertable in a terminal receiving chamber in said connector housing;

wherein hooks are formed on at least the other of said upper and lower walls, positioned to be engagable with holes formed in a similar connector housing.

8. A connector housing adapted for connection with an other connector housing, comprising:

upper and lower walls;

wherein holes are formed in at least one of said upper and lower walls, adapted to be engagable with both a retaining lance of a terminal insertable in a terminal receiving chamber in said connector housing and hooks of the other connector housing.

* * * * *